US006588836B1

(12) United States Patent
Lo

(10) Patent No.: US 6,588,836 B1
(45) Date of Patent: Jul. 8, 2003

(54) CHAISE LONGUE

(76) Inventor: Albert Chong-Jen Lo, 3023 Windy Knoll Ct., Rockville, MD (US) 20850

( * ) Notice: Subject to any disclaimer, the term of this patent is extended or adjusted under 35 U.S.C. 154(b) by 0 days.

(21) Appl. No.: 10/145,705

(22) Filed: May 16, 2002

(51) Int. Cl.[7] ..... A47C 4/00

(52) U.S. Cl. ..... 297/16.1; 297/45; 297/452.4; 297/463.1

(58) Field of Search ..... 297/16.1, 45, 42, 297/284.2, 284.1, 440.11, 452.13, 452.19, 452.4, 463.1

(56) References Cited

U.S. PATENT DOCUMENTS 488,095 A * 12/1892 Scott et al.
3,189,382 A * 6/1965 Fortier
4,234,226 A * 11/1980 Colby
4,592,126 A * 6/1986 Bottemiller
6,341,822 B2 * 1/2002 Apissomian
6,406,091 B1 * 6/2002 Saul et al.

* cited by examiner

*Primary Examiner*—Laurie K. Cranmer
(74) *Attorney, Agent, or Firm*—Bacon & Thomas, PLLC

(57) ABSTRACT

A chaise lounge includes a support device fixed at the rear side of two side rods to expand the two side rods to hold a soft surface sheet. The support device has two pivot bases respectively secured on the two side rods and having a pivot opening. The two pivot openings are respectively combined with a long and a short support member pivotally connected and movable relative to each other. The long support member has one end pivotally combined with the pivot opening and the other end formed with an arcuate edge. The long support member has its upper edge bent inward into a horizontal bend edge for holding the short support member. When the long and the short support member are controlled into a straight line, they will force the two side rods to expand outward together with the soft surface sheet.

3 Claims, 6 Drawing Sheets

CHAISE LONGUE

BACKGROUND OF THE INVENTION

This invention relates to a chaise lounge, particularly to one having a support device to make its soft seat and backrest sheet expanded outward when used, and collapsed when unused.

A conventional stationary chaise lounge is formed with a high backrest for a user to have his/her back rest thereon comfortably, but the size of the whole chaise lounge is so large that one container cannot carry a large number of them in transporting, thus, increasing transporting cost is disadvantageous to both makers manufacturers and consumers.

A conventional collapsible lounge has two-foot frames respectively formed with support members to stand on the ground, and the two support members are respectively screwed firmly with two side rods at two sides of a seat by means of screws. Thus, the seat can be separated from the foot frames to make its size smaller than a stationary chaise lounge, possible to increase transporting amount and lower transporting cost. However, the seat and backrest is made of a soft sheet (such as PVC net cloth), and the upper end of the backrest is supported by an inverted U-shaped rod secured on a rear side of the upper end of two vertical side rods to prevent the portion of the soft seat and backrest sheet held thereon from sagging. The inverted U-shaped rod forces the two side rods at opposite upper sides of the seat and backrest to expand outward to push flat the soft seat and backrest sheet for supporting the head of a user. The width of the inverted U-shaped rod is larger than the distance between the two side rods, so the two side rods have to be stretched outward by machine before they are combined with the inverted U-shaped rod, taking too much labor and time in manufacturing.

SUMMARY OF THE INVENTION

This invention has been devised to offer a chaise lounge provided with a support device, able to expand its soft seat and backrest sheet outward for use, and reduce its size when collapsed, easy in producing and convenient in transporting.

BRIEF DESCRIPTION OF DRAWINGS

This invention will be better understood by referring to the accompanying drawings, wherein.

DETAILED DESCRIPTION OF THE PREFERRED ENBODIMENT

Figure 1:
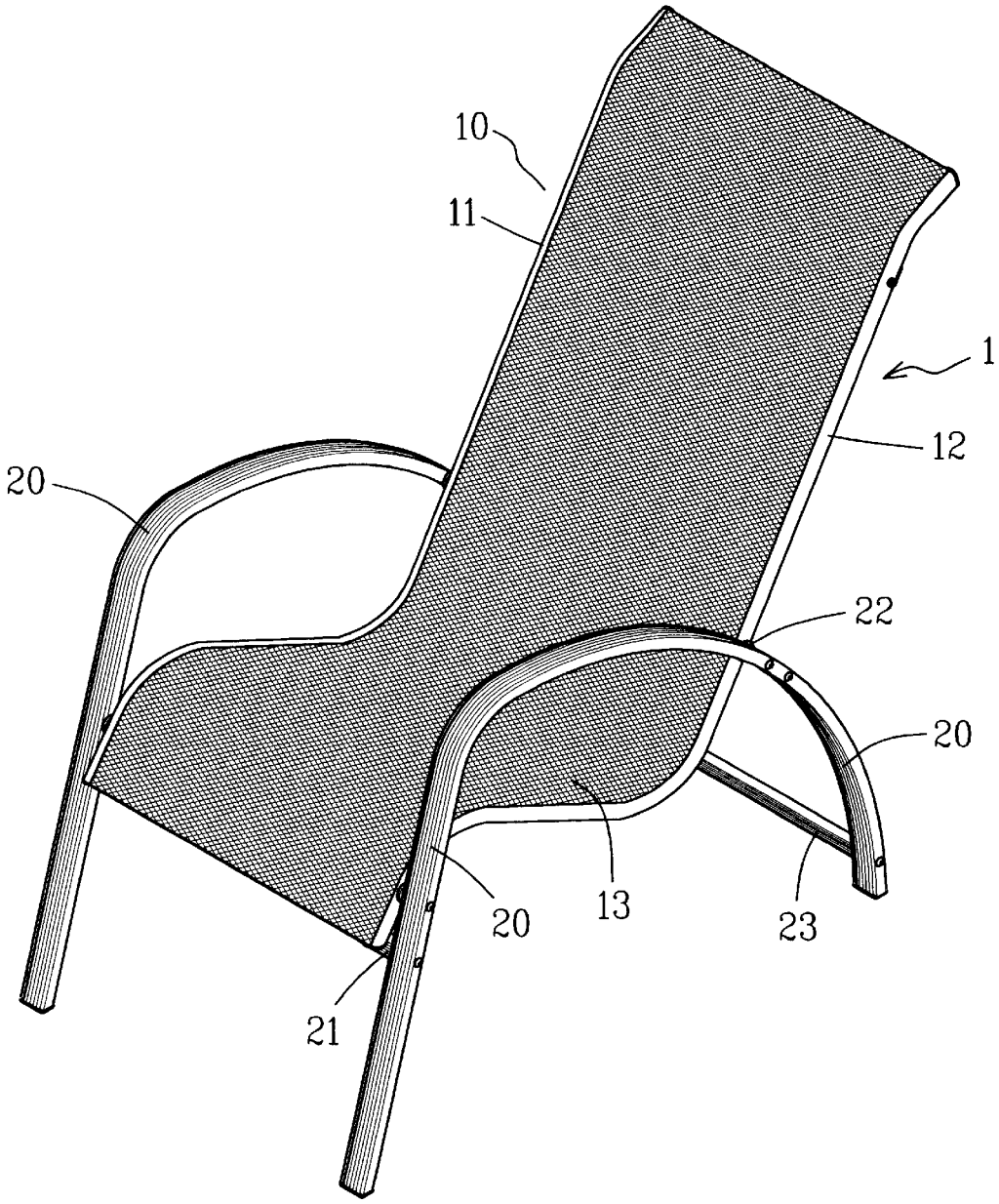
FIG. 1 is a perspective view of a chaise lounge in the preset invention.
Figure 2:
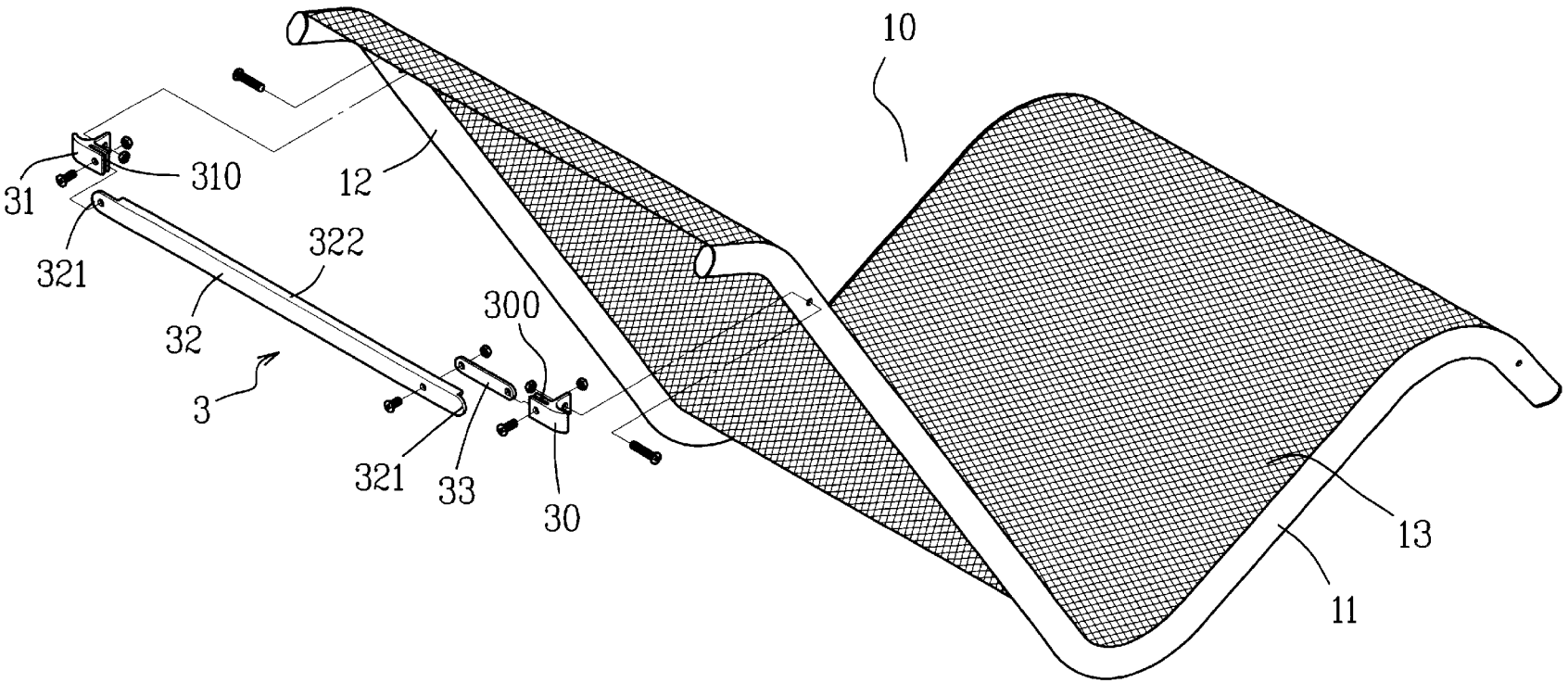
FIG. 2 is an exploded perspective view of the chaise lounge in the present invention.

A preferred embodiment of a chaise lounge in the present invention, as shown in FIGS. 1 and 2, includes a seat and backrest 10, two-foot frames 20 and a support device 3 combined together.

The two foot frames 20 are positioned separately at left and right, and have three lateral rods 21, 22 and 23 respectively assembled at a front portion, an intermediate portion and a rear portion between them by means of screws screwing through the side walls of the two foot frames 20, making up a foot frame base to stand on the ground, with the foot frame base able to be collapsed for facilitating storing and transporting.

Figure 3:
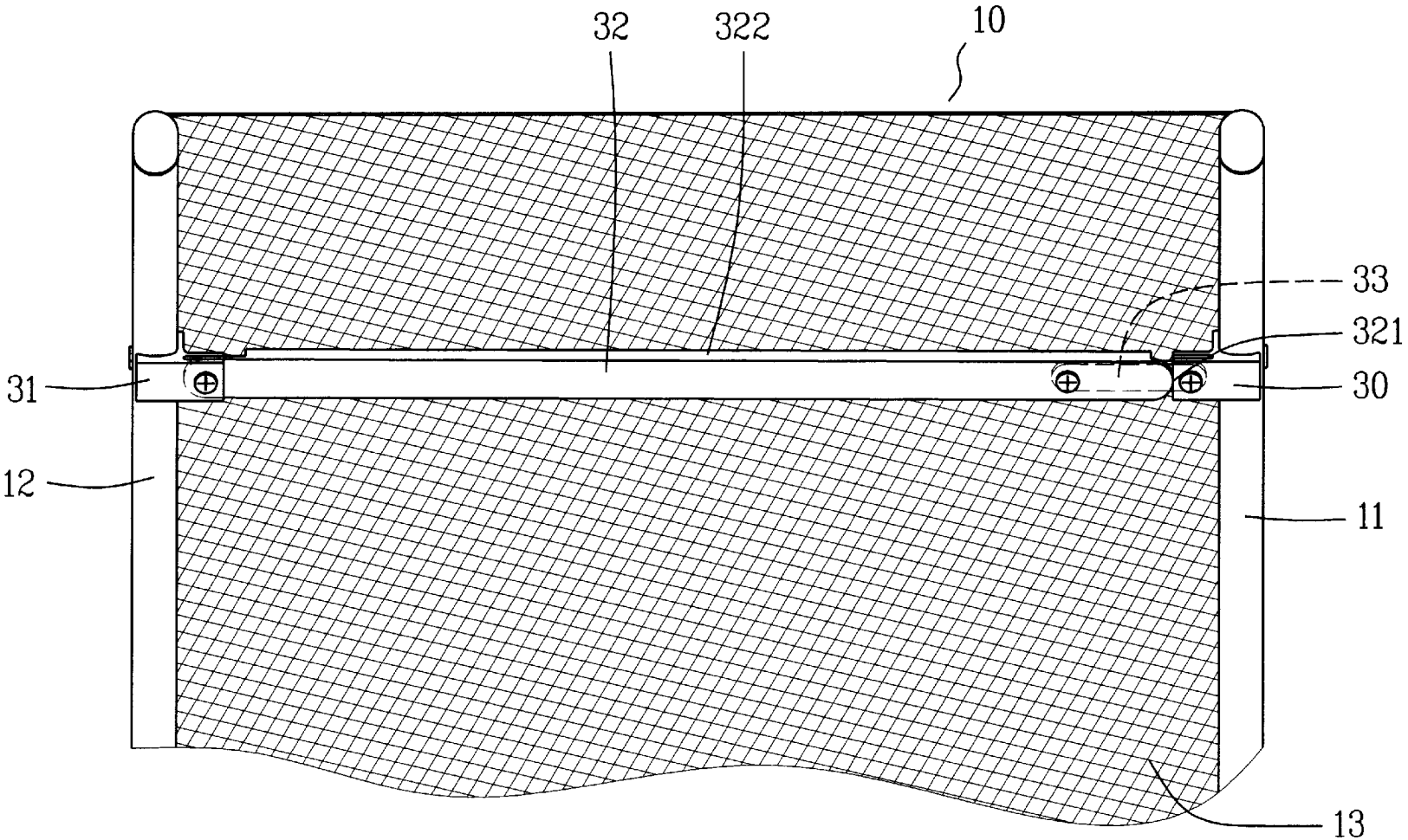
FIG. 3 is a rear view of a support device pivotally assembled in the present invention.
Figure 5:
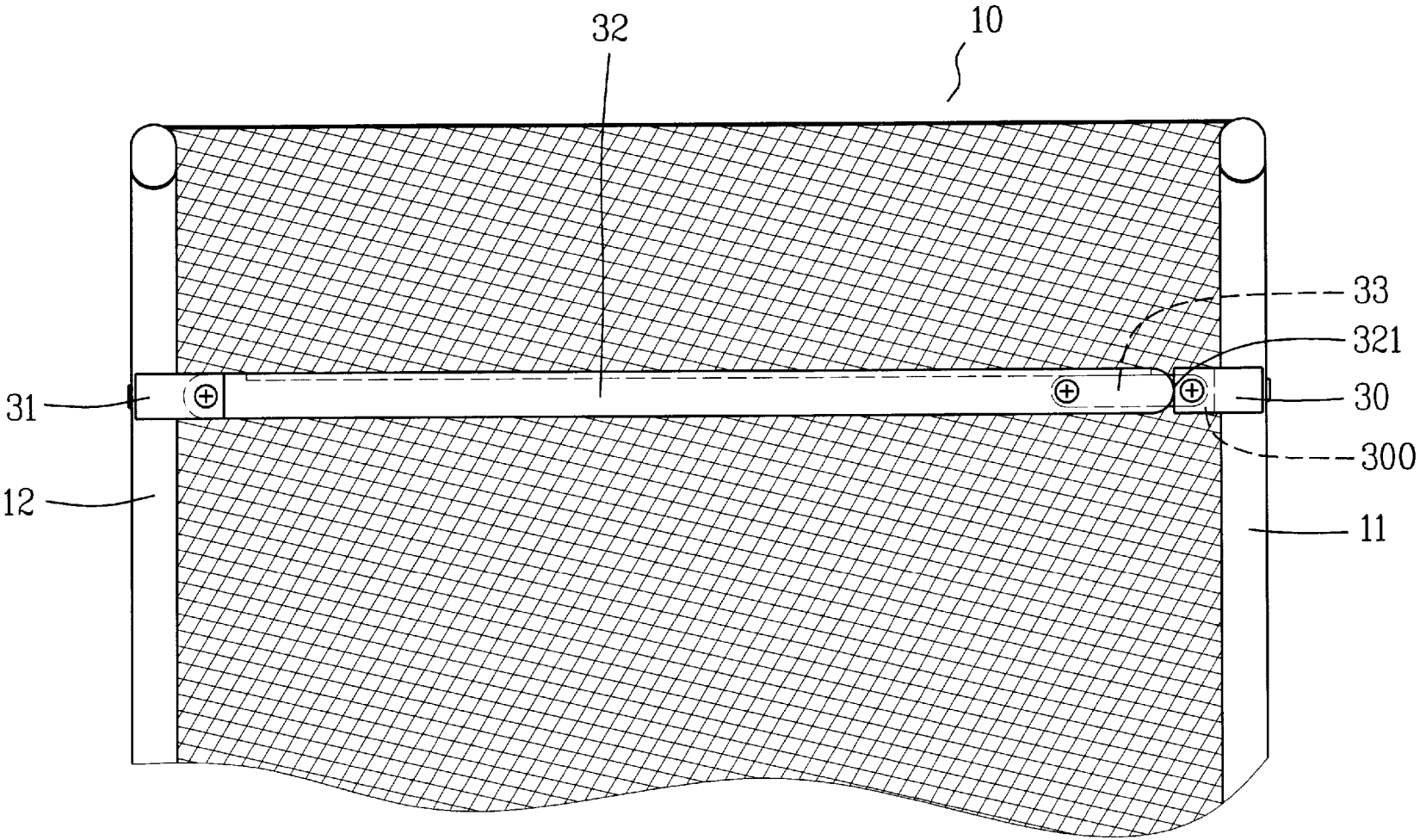
FIG. 5 is a rear view of the support device expanded in the present invention: and, FIG. 6 is an upper view of the support device expanded in the present invention.
Figure 6:
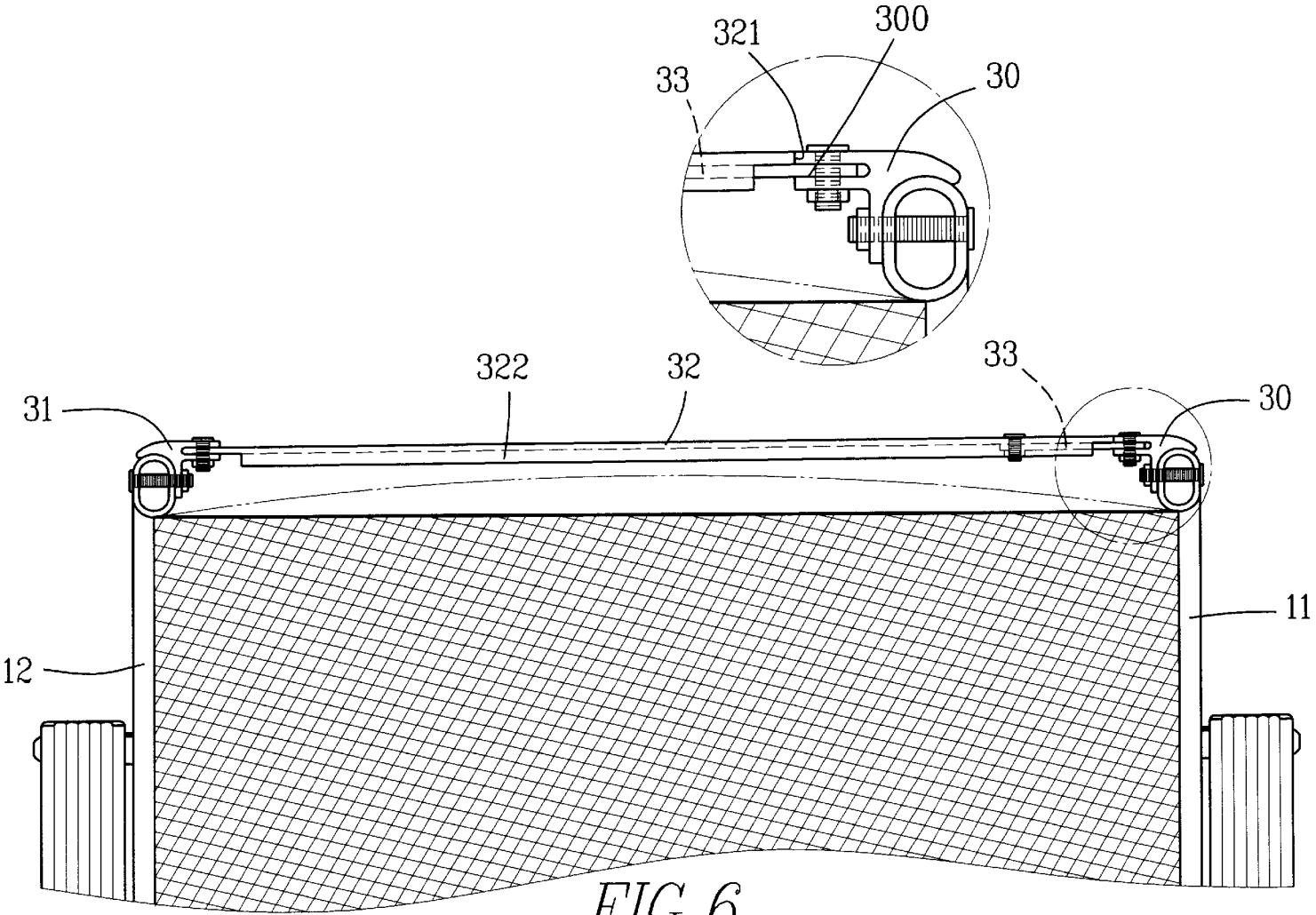

The seat and backrest 10 is composed of two side rods 11 and 12 and a soft sheet surface 13 made of soft material (such as PVC net cloth). The two side rods 11 and 12 are respectively formed with a front portion slanting downward, an intermediate portion for a seat, and a rear portion slanting upward for a backrest, and are respectively screwed together with the foot frames 20 for receiving the soft seat and backrest sheet 13. Then, a support device 3 is provided between the two side rods 11, 12, positioned at the rear upper ends of the two side rods 11, 12 for pushing the two side rods 11, 12 outward, as shown in FIGS. 3, 5 and 6. The support device 3 can also be provided under the intermediate portion of the two side rods 11, 12 for making the soft surface sheet expanded outward for a user to sit thereon comfortably.

Specifically, the support device 3, as shown in FIG. 2, is composed of two pivot bases 30, 31 respectively fixed on the two side rods 11, 12. The two pivot bases 30, and 31 are respectively formed with a pivot opening 300, 310 faxing each other. The pivot opening 310 is pivotally connected with a long support member 32, while the pivot opening 300 pivotally connected with a short support member 33, having the long support member 32 and the short support member 33 pivotally connected and movable relative to each other.

Further, the long support member 32 is a flat rod with a proper thickness and strength and has one end pivotally combined with the pivot opening 310 of the pivot base 31 fixed on the side rod 12. The long support member 32 has both ends respectively formed with an arcuate edge 321, and has its upper edge bent inward into a horizontal bend edge 322 to act as a blocking wall for holding the short support member 33 located under, as shown in FIG. 6. The short support member 33 is of a proper thickness and strength, and has one end pivotally combined with the pivot opening 300 of the pivot base 30 secured on the side rod 11, and the other end pivotally connected with the long support member 32. Thus, when the long support member 32 and the short support member 33 are disposed in a straight line, the arcuate edge 321 of the long support member 32 just slightly pushes against the edge of the pivot opening 300 of the pivot base 30. Then the arcuate edge 321 enables the long support member 32 push against or separate from the edge of the pivot opening 300 with easiness and with little force, rendering the two side rods 11, 12 easily expanded outward, as shown in FIGS. 3 and 4.

Figure 4:
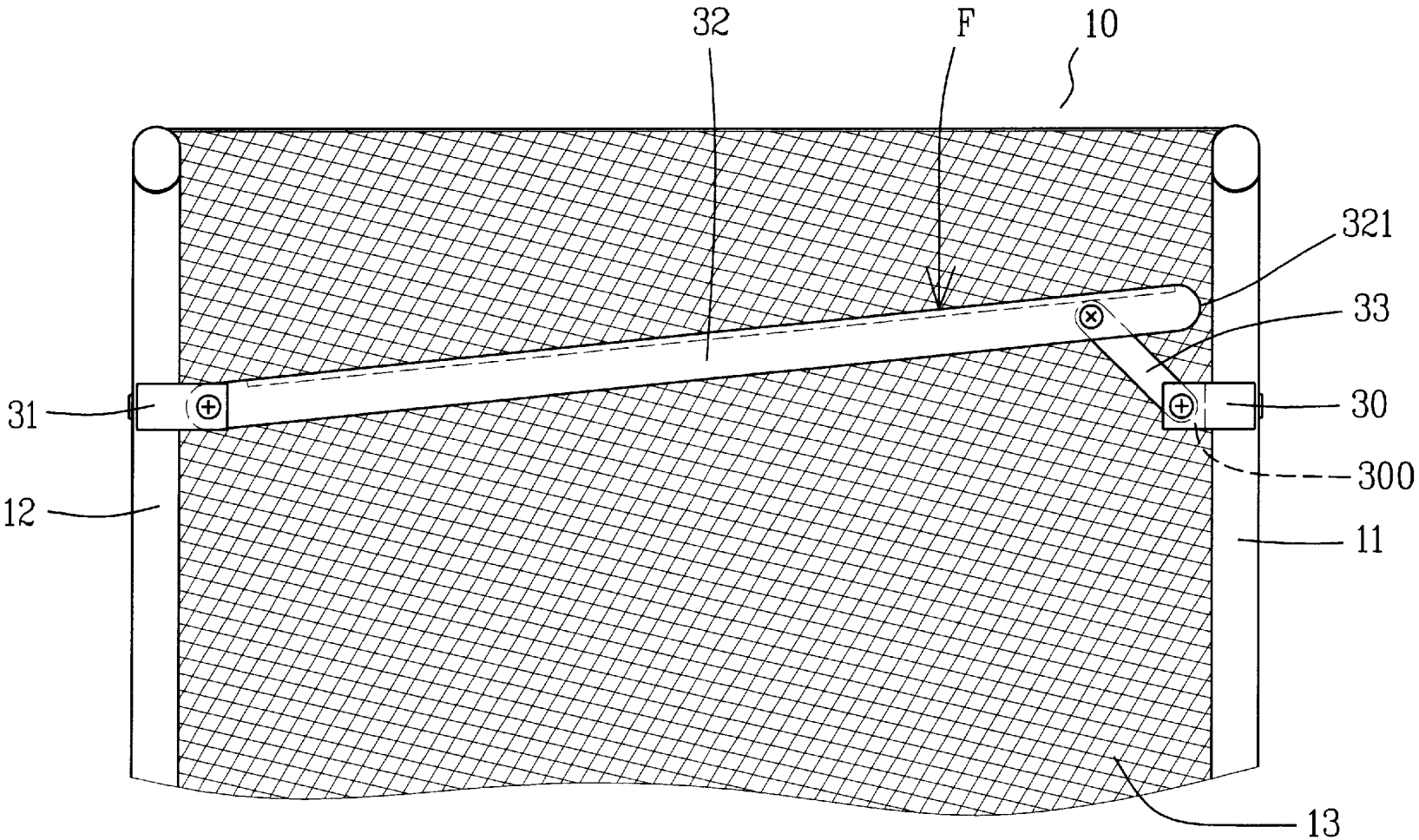
FIG. 4 is a rear view of the support device in a using condition in the present invention.

Thus, when the long and the short support members 32, 33 are expanded to the largest angle, the arcuate edge 321 of the long support member 32 pushes against the edge of the pivot opening 300 of the pivot base 30, obtaining supporting and positioning effect, as shown in FIGS. 4, 5 and 6. Besides, the horizontal bend edge 322 on the inner upper end of the long support member 32 can stably hold the upper edge of the short support member 33.

Furthermore, the whole length of the long support member 32 and the short support member 33 expanded fully is a little larger than the distance between the two pivot openings 300, 310. Therefore, when the long and the short support members 32 and 33 respectively have their outer ends fixedly combined with the two pivot bases 30, 31, as shown in FIG. 3, and the long support member 32 is pressed down in the direction (F) shown in FIG. 4, the two support members 32 and 33 will be expanded to the largest angle to force the soft surface sheet 13 to normally expand outward, thus preventing the top portion of soft surface sheet 13 from sagging when a user's head rests thereon and letting the user feel comfortable when lying on it.

On the contrary, when unused, the two support member 32, 33 of the support device 3 can be pulled inward to become loose, as shown in FIG. 4, so as to prevent the soft surface sheet from being always expanded outward and accordingly reducing its resilience after used for a long period of time. Moreover, the whole length of the two support member 32, 33 of the support device 3 in a fully expanded position is larger than the distance between the two side rods 11, 12, therefore the soft surface sheet 13 between the two side rods 11 and 12 can be expanded smooth, and besides, the intermediate portion of two support members 32, 33 may slightly be curved backward because the support device 3 is confined between the two foot frames 20, as shown in FIG. 6. And between the backward curved portion of the two support members 32, 33 and the soft surface sheet 13 is formed a distance, which may enable the soft surface sheet sagging slightly to prevent a user's head (or buttocks) from directly bumping the support device 3 when resting thereon.

As can be noted from the above description, the chaise lounge in the present invention is preferable to a conventional one. The chaise lounge of this invention doesn't have to push outward its support device 3 for expanding the soft surface sheet 13 outward when it is unused. Only when the chaise lounge is to be used, does the support device 3 need to be stretched outward, thus getting rid of the defect of the conventional chaise lounge that the soft surface sheet may gradually reduce.

While the preferred embodiment of the invention has been described above, it will be recognized and understood that various modifications may be made therein and the appended claims are intended to cover all such modifications that may fall within the spirit and scope of the invention.

I claim:

1. A chaise lounge comprising two foot frames, three lateral rods fixed between said two foot frames respectively at a front portion, an intermediate portion and a rear portion, a seat and backrest fastened firmly with said two foot frames, said seat and backrest composed of two side rods and a soft surface sheet provided between said two side rods, said two side rods respectively formed with a front portion slanting downward, an intermediate portion serving as a seat and a rear portion slanting upward as a backrest: and, Characterized by a support device pivotally fixed between said two side rods for expanding said two side rods upward, said support device composed of a right and a left pivot base, said two pivot bases respectively secured on said two side rods and respectively formed with a pivot opening facing each other, said two pivot openings respectively combined pivotally with a long support member and a short support member, said long and said short support members pivotally connected to each other, said long support member having both ends respectively formed with an arcuate edge, said long support member having one end pivotally combined with said pivot opening of said left pivot base, said long support member having its upper edge bent inward into a horizontal bend edge for stably holding said short support member located under, said long support member having its arcuate edge slightly pushing against an edge of said pivot opening of said right pivot base when said long and said short support members are disposed in a straight line to expand said two side rods outward together with said soft surface sheet.

2. The chaise lounge as claimed in claim 1, wherein said two side rods each has a rear upper end and said support device is fixed with the rear upper ends.

3. The chaise lounge as claimed in claim 1, wherein said support device is fixed with a rear intermediate portion of said two side rods.

* * * * *